US007174840B2

(12) United States Patent
Scanzani

(10) Patent No.: US 7,174,840 B2
(45) Date of Patent: Feb. 13, 2007

(54) MANIPULATOR USED TO REVERSE THE EDGES OF SLASH POCKETS

(76) Inventor: Beniamino Scanzani, Via Imbrecciata, 37, I-60024 Filottrano (AN) (IT)

( * ) Notice: Subject to any disclaimer, the term of this patent is extended or adjusted under 35 U.S.C. 154(b) by 0 days.

(21) Appl. No.: 11/073,157

(22) Filed: Mar. 4, 2005

(65) Prior Publication Data

US 2005/0223959 A1 Oct. 13, 2005

(30) Foreign Application Priority Data

Apr. 8, 2004 (IT) ..... MC2004A0056
Jul. 26, 2004 (IT) ..... MC2004A0102

(51) Int. Cl.
*D05B 3/10* (2006.01)
*D05B 37/02* (2006.01)
*D05B 35/00* (2006.01)

(52) U.S. Cl. ..... 112/470.16; 112/68

(58) Field of Classification Search ..... 112/470.14, 112/470.07, 470.18, 470.16, 65, 68, 70, 470.28, 112/470.33, 475.06, 475.09
See application file for complete search history.

(56) References Cited

U.S. PATENT DOCUMENTS 2,529,072 A * 11/1950 Bradford et al. ..... 112/68
3,814,037 A * 6/1974 Nicolay ..... 112/68
4,034,689 A * 7/1977 Hintzen et al. ..... 112/68
4,337,881 A * 7/1982 Off et al. ..... 223/1
4,341,169 A * 7/1982 Mainot et al. ..... 112/78
5,272,994 A * 12/1993 Scholl et al. ..... 112/470.18
5,513,585 A * 5/1996 Diekmann et al. ..... 112/68

* cited by examiner

*Primary Examiner*—Ismael Izaguirre
(74) *Attorney, Agent, or Firm*—Armstrong, Kratz, Quintos, Hanson & Brooks, LLP

(57) ABSTRACT

A manipulator used to reverse the edges of slash pockets, which consist in two pieces of fabric folded so that they internally hold and coat one of the two sides of the pocket cut.

8 Claims, 11 Drawing Sheets

MANIPULATOR USED TO REVERSE THE EDGES OF SLASH POCKETS

The present invention refers to a manipulator used to reverse the edges of slash pockets, which consist in two pieces of fabric folded so that they internally hold and coat one of the two sides of the pocket cut.

The present patent application refers to a manipulator used to reverse the edges of slash pockets obtained from a special sewing machine, which automatically cuts the pocket and sews the edges, consisting in two pieces of fabric folded so that they internally hold and coat one of the two edges of the pocket cut.

Currently, the reversal operation is carried out manually and therefore the manipulator of the invention is an absolute authentic novelty.

In view of the multiple complex elements used in the automatic folding of the pocket edges, the description continues with reference to the enclosed drawings, which are intended for illustration purposes only, and not in a limiting sense, whereby:

Figure 7:
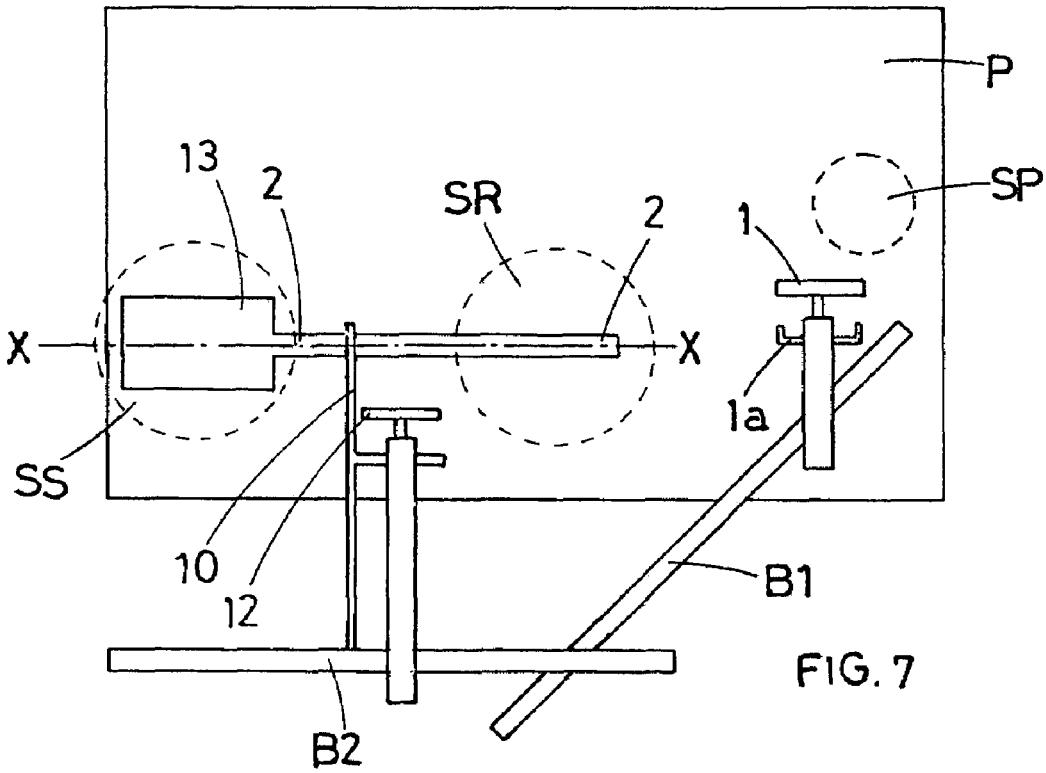

FIG. 7 is a diagrammatic view illustrating the position on the worktop of the station where the manipulator of the invention reverses the edges of the pocket, being such a station located upstream of the ironing station and downstream of the station where the semi-finished product obtained from the special machine used to cut the pocket and sew the edges in external position with respect to the two sides of the pocket is picked up.

Figure 8:
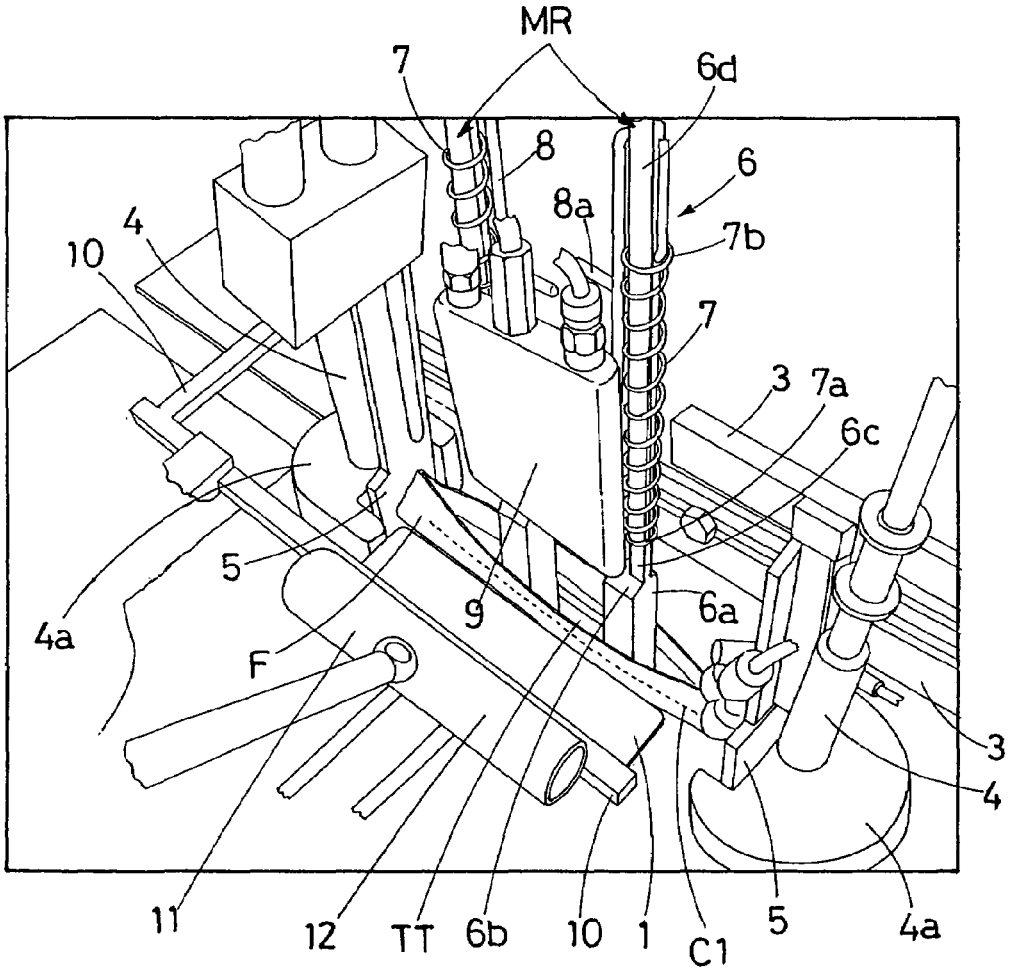
Figure 9:
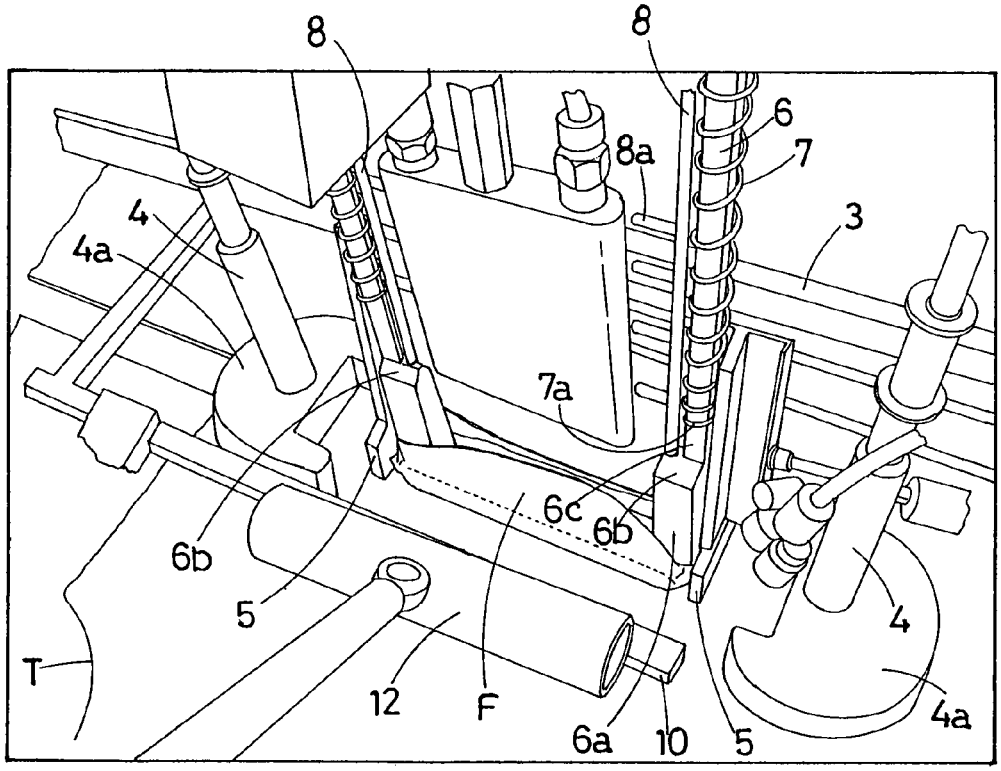

FIGS. 8 and 9 are two perspective diagrammatic views of two consecutive steps of the reversal operation carried out by the manipulator of the invention.

FIGS. 10A to 10E are diagrammatic views of the sequence of steps carried out to reverse the edges of the pocket, from the external to the internal side.

Figure 11:
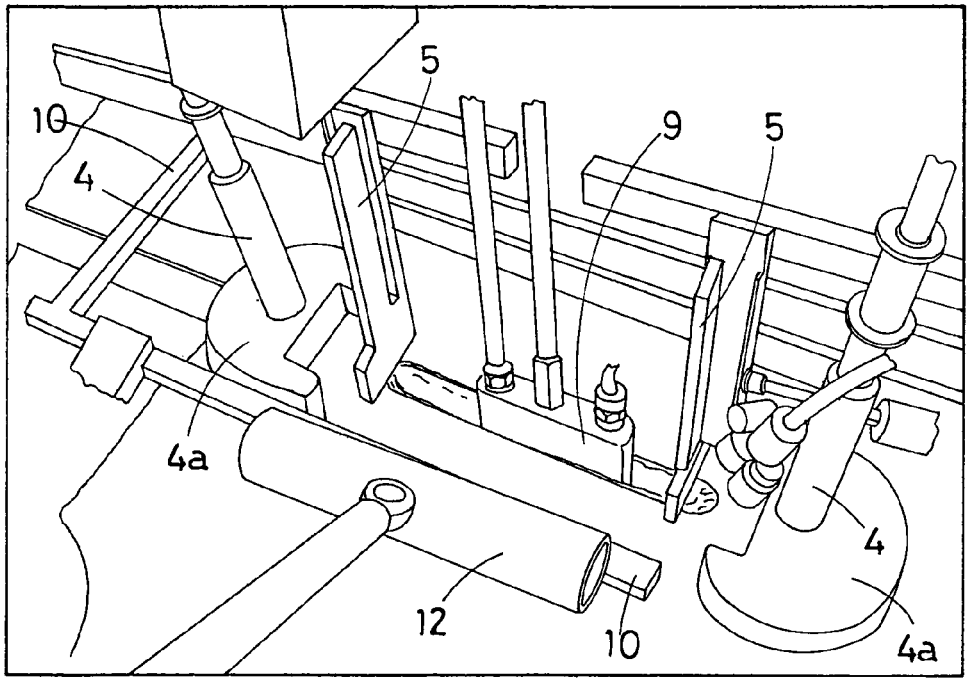

FIG. 11 illustrates the descending phase of a shutter that is actuated during the reversal operation.

Figure 12:
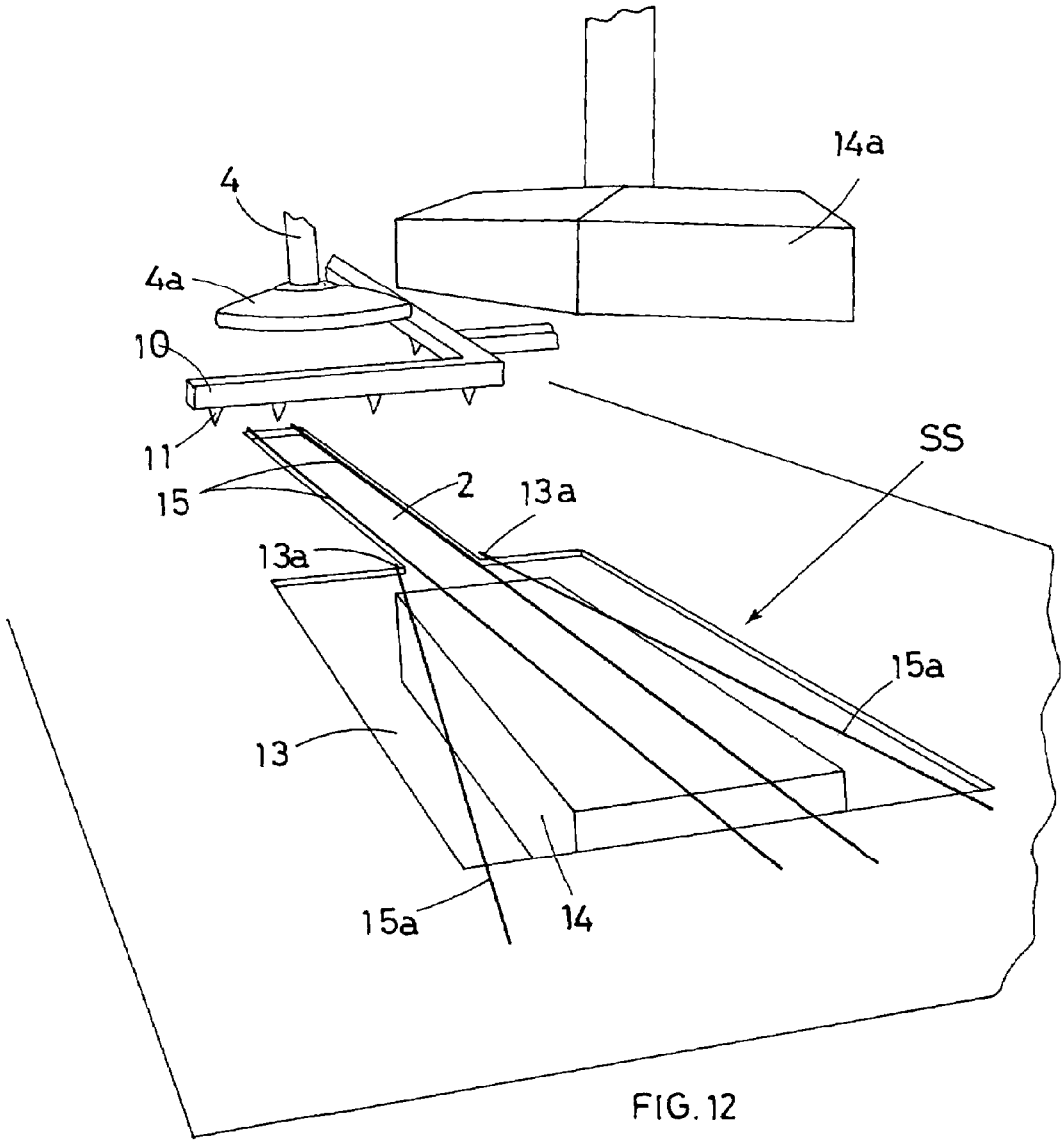

FIG. 12 is a perspective view of the ironing station.

With reference to the aforementioned figures, the manipulator of the invention is used on a semi-finished product composed of the fabric where the pocket is to be cut, of the edges with relative reinforcements and of a piece of lining used to cover the pocket opening from the inside.

Figure 1:
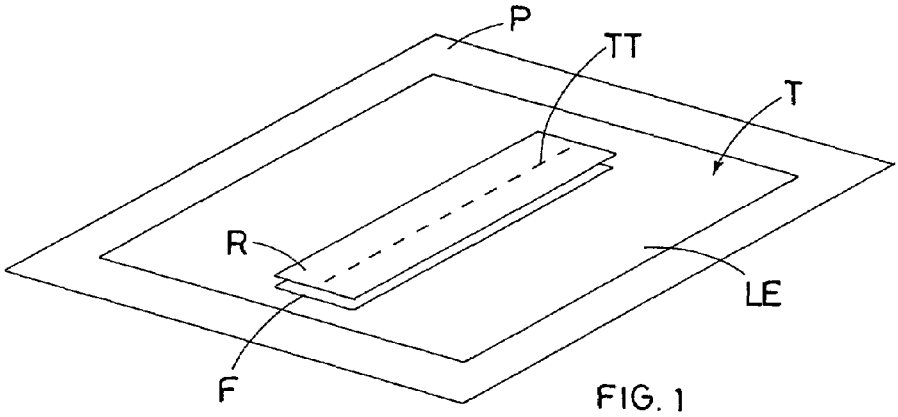
FIG. 1 is a diagrammatic view illustrating the way the fabric and edges are placed on the worktop of the machine used to cut the pocket and sew the edges outside the two sides of the pocket cut.
Figure 2:
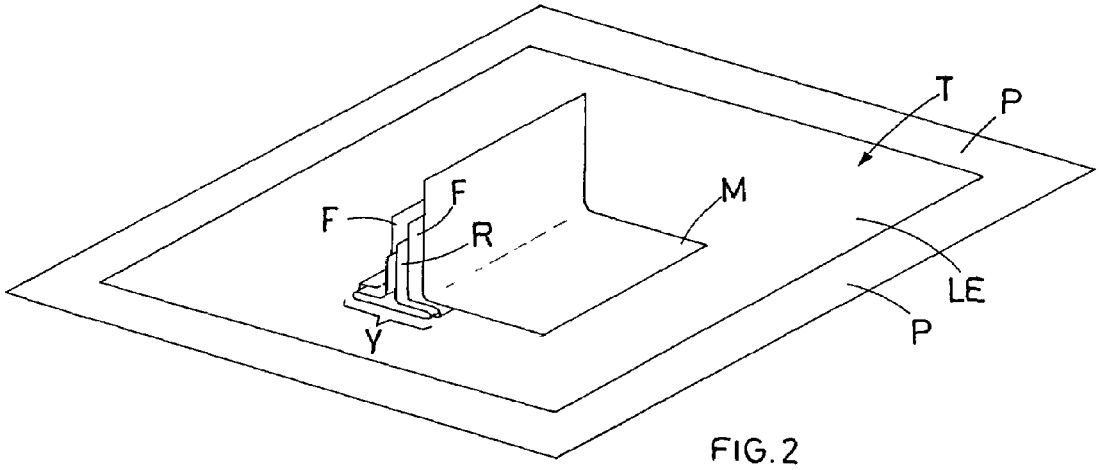
FIG. 2 illustrates the way the machine folds the edges before cutting the pocket and sews the edges in external position with respect to the sides of the pocket cut.
Figure 3:
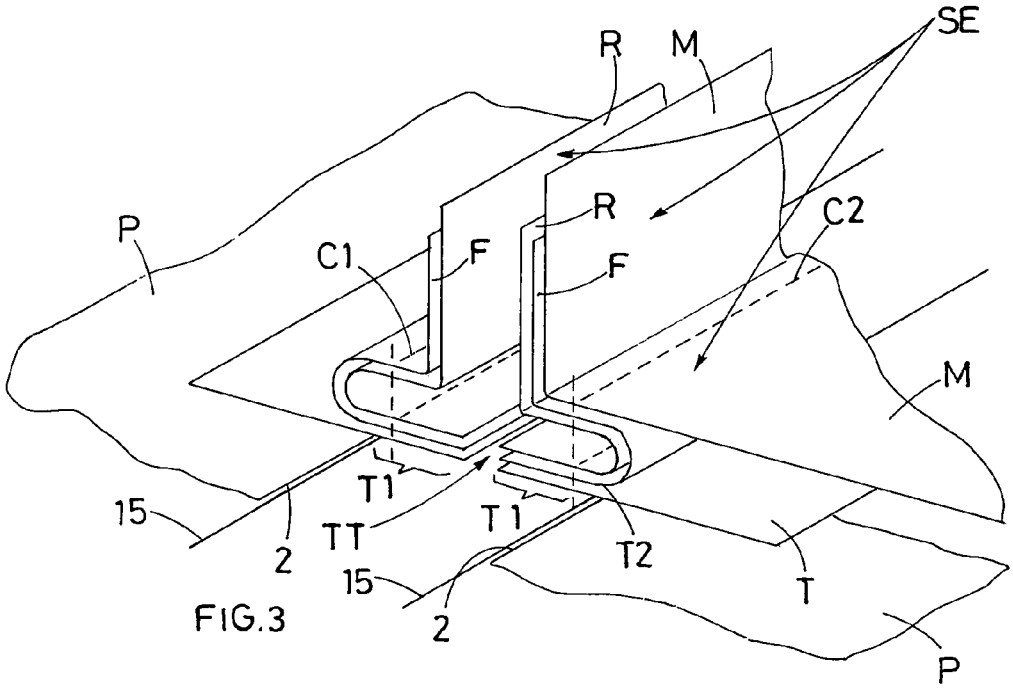
FIG. 3 is a cross-section with a transversal plane of the semi-finished product obtained from the special machine used to cut the pocket and sew the edges in external position with respect to the two sides of the pocket cut.

For a better illustration of the operation modes and elements of the manipulator of the invention, the description continues with reference to the configuration of the semi-finished product shown in FIGS. 1 to 3, which diagrammatically illustrate the mutual position of the elements that form the semi-finished product (SE).

As shown in FIG. 1, the fabric (1) is placed over the worktop (P) with the external side (LE) upwards.

A first rectangular piece of fabric, hereinafter defined as edge (F), and a second rectangular piece of fabric, hereinafter defined as reinforcement (R), are placed over the fabric (T) where the pocket cut (TT) is to be made, as shown with a broken line.

An automatic machine is used to fold the edge (F) and the reinforcement (R) so that they are given a reversed-T shape, and apply a third piece of fabric, hereinafter defined as facing (M), folded in L-shape and placed at one side of the edge (F), which has been previously given a reversed-T shape, as shown in FIG. 2, precisely on the upper side of the pocket cut (TT).

Figure 4:
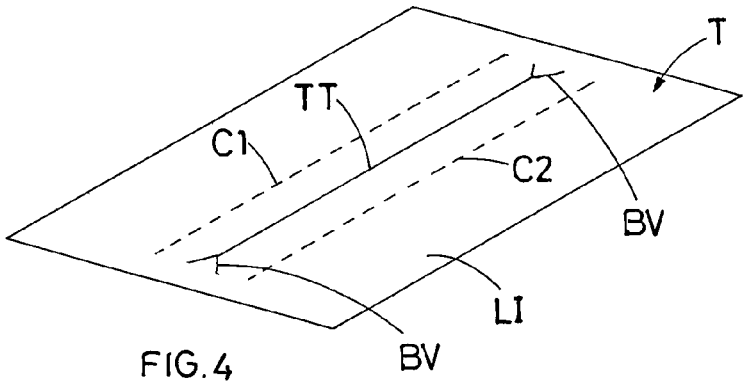
FIG. 4 is a view of the semi-finished product of FIG. 3 seen from the internal side of the fabric.

The same automatic machine is used to make the central cut on the fabric (T), on the reinforcement (R) and on the edge (F), as shown in FIG. 3, which coincides with the pocket cut (TT), and simultaneously make a parallel pair of seams (C1 and C2) with parallel equidistant direction with respect to the pocket cut (TT), ending on both sides with a V-element, hereinafter defined as (BV), as shown in FIG. 4.

It is apparent that the seam C2 located on the upper part (PS) of the pocket cut (TT) affects the facing (M), the edge (F) and the reinforcement (R), while the seam C1 located on the lower part (PI) of the pocket cut (TT) only affects the edge (F) and the reinforcement (R), as shown in FIG. 3.

The upper part (PS) of the pocket cut (TT) is the part that will be located above the pocket opening and the lower part (PI) is the part that will be located below the pocket cut (TT).

Figure 5:
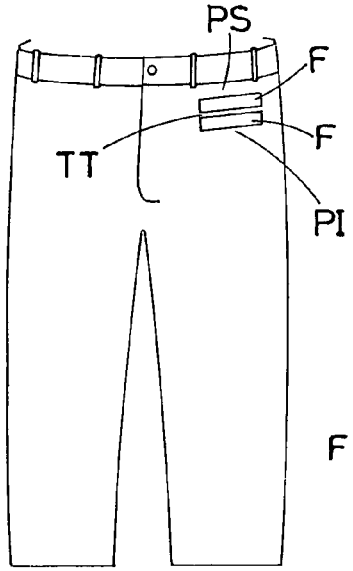
FIG. 5 is a diagrammatic view illustrating the pocket of a pair of trousers finished with the said edges, with one edge over and one edge under the pocket cut.

FIG. 5 diagrammatically illustrates the pocket of a pair of trousers, showing the pocket cut (TT), the edges (F) of the pocket cut (TT), the upper part (PS) and the lower part (PI) of the pocket cut (TT).

As shown in FIG. 3, (T1) indicates the reinforcements (R) and the edges (F) extending between the pocket cut (TT) and the seams (C1 and C2); (T2) indicates the reinforcements (R) and the edges (F) folded and sewn on the opposite side of the sections (T1) with respect to the seams (C1 and C2).

Figure 6:
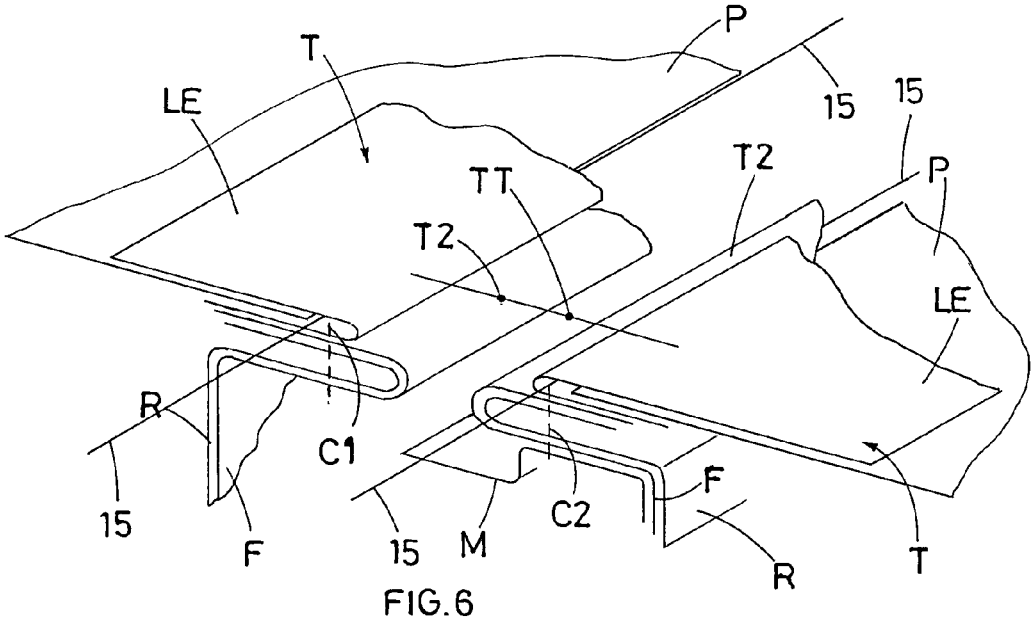
FIG. 6 is a view of the semi-finished product of FIG. 3 with the edges in reversed position inside the pocket cut.

In view of the above, the manipulator of the invention is used to fold downwards the facing (M), the edge (F) and the reinforcement (R) so that they are brought below the fabric (T), that is to say on the internal side (LI), after going through the pocket cut (TT), so that the pocket cut (TT) is visible on the external side (LE) of the fabric (T) and perfectly finished by two parts that coincide with the folded sections (T2), while the facing (M) simply falls onto the internal part of the pocket cut (TT), as shown in FIG. 6.

This description continues with the elements and the sequence of operational steps used to automatically reverse the facing (M), the edge (F) and the reinforcement (R) to obtain the semi-finished product (SE) shown in FIG. 6, which was received in the position shown in FIG. 3.

As diagrammatically shown in FIG. 7, the manipulator of the invention comprises a first track (B1) with a sliding extendable blade (1) that travels between the two stop limits identifying the pick-up station (SP) and the reverse station (SR), respectively.

The manipulator comprises a fork (1*a*) located below the blade (1), which co-operates with the blade (1) to fasten the fabric (T) above the worktop (P) and transfer it from the pick-up station (SP) to the reverse station (SR).

In the pick-up station (SP) the fork (1*a*) descends to fasten the fabric (T) in two points near the pocket; then the blade (1) extends to hold the fabric (T) in a very exact point near the section (T2) on the lower part (PI), facing towards the blade (1).

The blade (1) and the fork (1*a*) are operated by pneumatic actuators and travel along the track (B1) to transfer the semi-finished product (SE) to the second station (SR), where the extendable blade (1) and the fork (1*a*) retract not to interfere with the reverse means (MR) that operate in this station.

In the reverse station (SR) the semi-finished product (SE) is positioned so that the pocket cut (TT) is perfectly centered with respect to a slot (2) on the worktop (P), under which the reverse means (MR) are located.

A frame (3) is located over the slot (2) and supports a pair of legs (4) ending with two large circular feet (4*a*) used to fasten the fabric (T) over the worktop (P) during the reversal operation.

The frame (3) supports an opposite pair of vertical jaws (5) located inside the pair of legs (4), at such a distance that allows the base feet (4*a*) to fasten the fabric (T) in two external points with respect the V-elements (BV).

The jaws (5) are coupled to the frame (3) so that they can make simultaneous opposite alternate horizontal travels and the frame (3) can make alternate vertical travels.

The reversal operation comprises an ordered sequence of 5 steps (FIGS. 8 to 11) that are described hereinafter in detail.

During the first step (I) the frame (3) is lowered to bring the feet (4*a*) of the legs (4) in contact with the fabric (T), fastening it to the worktop (P); the jaws (5) are dimensioned in such a way that, when the frame (3) is lowered, the base touches the fabric (T) without pressing it.

Before the frame (3) starts to descend, two bridges (H) (shown in FIGS. 10A to 10E) are moved forward under the worktop (P) and touch the lower side of the slot (2) to transversally cover the slot (2) in order to determine the continuity of the worktop (P) on the contact points of the feet (4*a*), thus ensuring the perfect fastening of the semi-finished product (SE) between the feet (4*a*) and the worktop (P) during the next step when the edges of the pocket are reversed.

During the second step (II) (FIG. 8) the reverse means (MR) raise from below the worktop (P) passing through the slot (2) and the pocket cut (TT); while the fork (1*a*) remains pressed against the fabric (T) and the blade (1) slightly raises, since the fabric (T) is still fastened by the feet (4*a*).

The reverse means (MR) comprise a pair of rods (6) at a distance lower than the distance of the jaws (5), which rest in idle position under the worktop (P) on the slot (2); each rod (6) has a square truncated base (6*a*) with sides larger than the distance between the two seams (C1 and C2).

The truncated base (6*a*) is joined with the rod (6) by means of a step (6*b*); a metal rod (7) is helicoidally wound around the rod (6), with the first turn (7*a*) raised with respect to the connection step (6*b*) so that a short section (6*c*) of the rod between the step (6*b*) and the first turn (7*a*) and the top section (6*d*) of the rod (6) over the last turn (7*b*) of the metal rod (7) remain uncovered.

A vertical comb (8) is placed on the internal side of each rod (6), with horizontal teeth (8*a*) laying on a plane passing through the pocket cut (TT).

As shown in FIG. 8, the rods (6) are moved closer when they are raised over the worktop (P).

Going back to the description of the operational steps, after the reverse means (MR) have raised, the rods (6) are diverged in such a way that the truncated base (6*a*) forces the V-elements (BV) at the two ends of the pocket cut (TT).

Figure 10A:
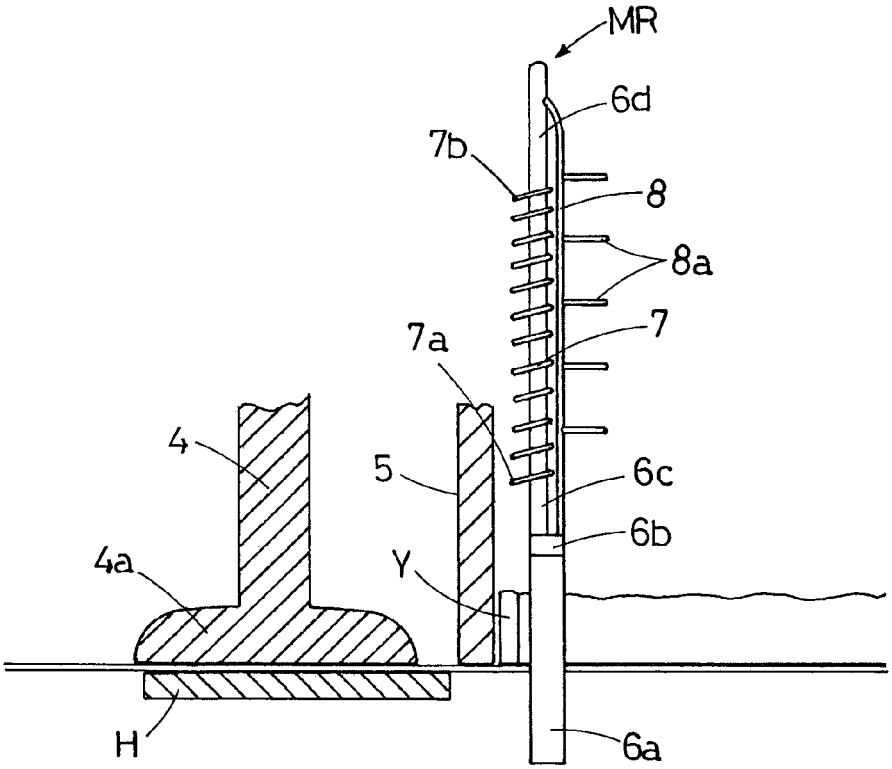
Figure 10B:
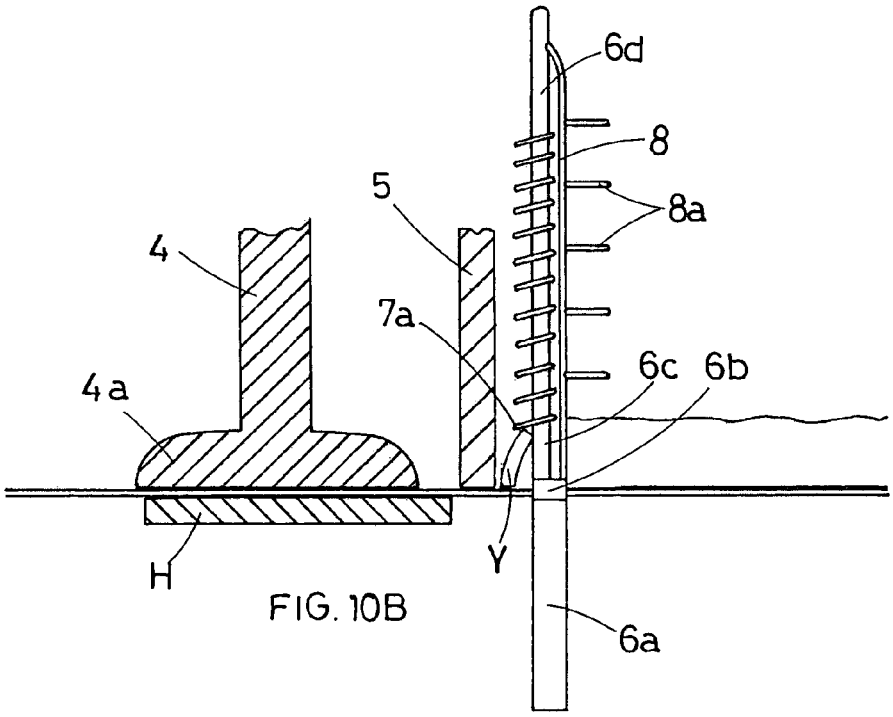
Figure 10C:
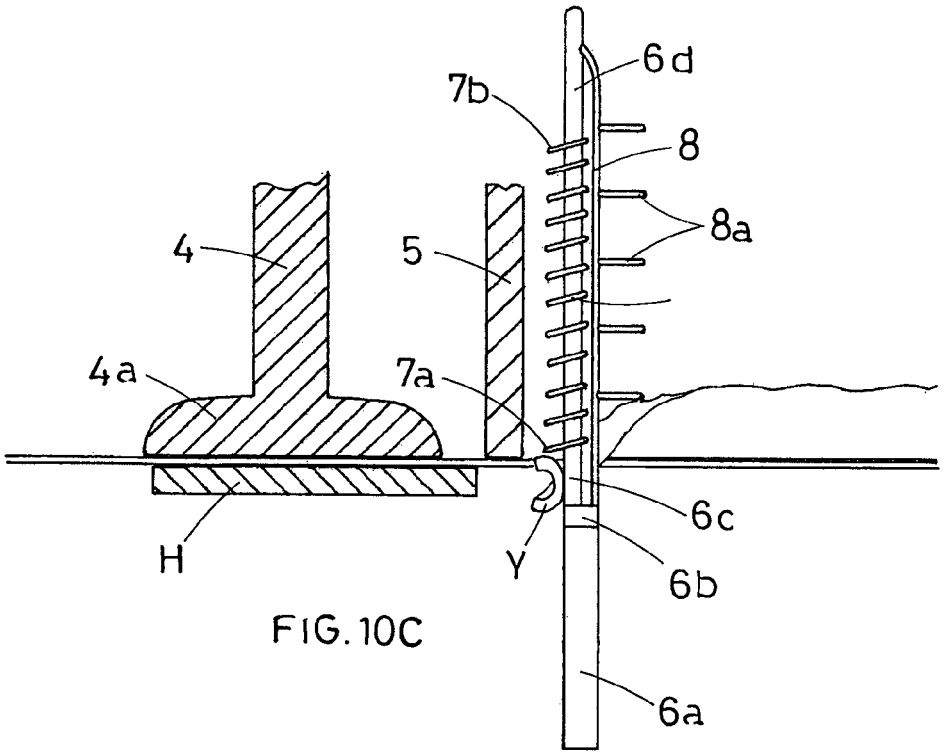
Figure 10D:
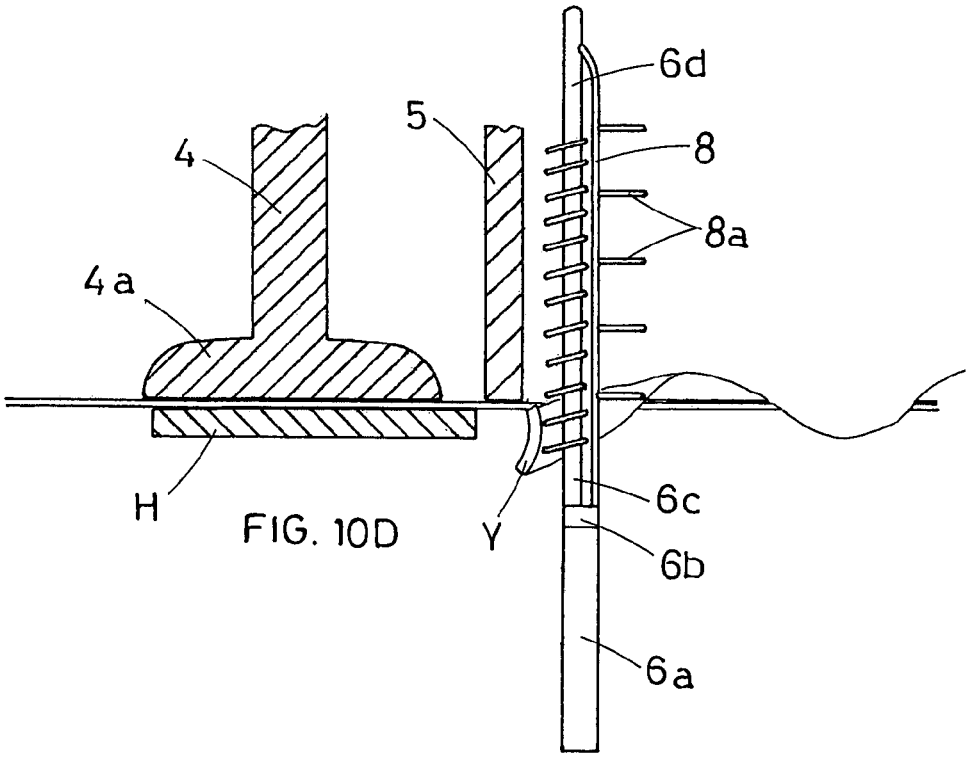
Figure 10E:
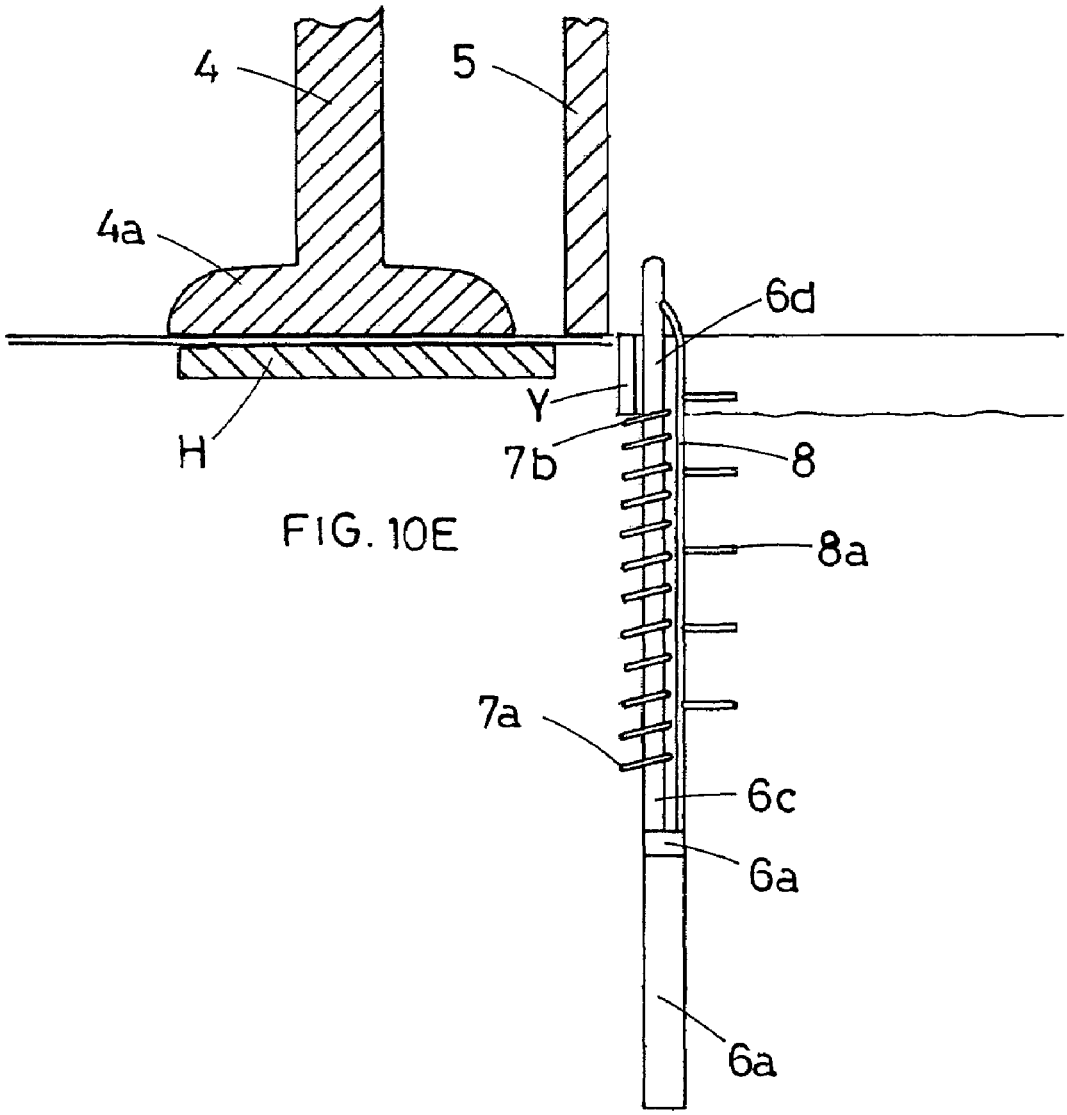

The jaws (5) close and slide on the fabric (T) to intercept and partially reverse upwards the transversal sections (Y) of the edge (F), of the reinforcement (R) and of the sampling (M) located in external position with respect to the V-elements (BV) of the pocket cut (TT), as shown in FIG. 9 and FIG. 10A.

The third step (III) can be divided in five phases (IIIA, IIIB, IIIC, IIID, IIIE), which are hereinafter described in detail with reference to FIGS. 10A to 10E, in which for easier reference only one rod (6) with respective jaw (5) is diagrammatically indicated.

During the five phases the rods (6) cooperate with the jaws (5) to completely reverse the edge (F), the reinforcement (R) and the facing (M) under the pocket cut (TT).

As shown in FIG. 10A, during the first phase (IIIA) the rods (6) descend and receive a diverging force opposed by the pair of jaws (5) located against the truncated base (6*a*).

The second phase (IIIB) (FIG. 10B) starts when the truncated base (6*a*) is placed under the pocket cut (TT), while the rods (6) continue to descend.

In this phase the aforementioned diverging force exercised against the rods (6) is cancelled, so that the transversal sections (Y) that were partially reversed by the jaws (5) fall inwards under the action of the jaws (5) and rest against the short uncovered section of the rod (6*c*) immediately over the connection step (6*b*), reaching the position that allows the third phase to begin correctly.

The third phase (IIIC) (FIG. 10C) starts with the interception of the sections (Y) by the helical rod (7) that engages and drags them downwards because of friction, thus bringing them in reverse position under the worktop (P) as desired.

The jaws (5) cease pushing when the first turn (7*a*) is brought under the worktop (P).

The fourth phase (IIID) (FIG. 10D) ends near the top turn (7*b*) of the helical rod (7), when the jaws (5) cease pushing inwards, and the rods (6) remain in diverged position until the end of their travel.

The fifth and last phase (IIIE) (FIG. 10E) starts when the turns of the helical rod (7) move beyond the pocket cut (TT), being brought under the worktop (P), with the jaws (5) in close position, without pushing.

Attention is drawn on the function of the last section of rod (6*d*) that is not surrounded by the turns of the helical rod (7), which is designed to prevent the small triangular pieces of fabric located between the V-elements (BV) of the pocket cut from remaining over the sections (T2) of the pocket edges, when the reversal operation is completed.

This is because the sections (T2) remain slightly open until the rod (7) is placed between them.

After the passage of the last turn (7*b*), the sections (T2) spontaneously tend to raise and resume a mutually matching flat position. On the contrary, the pieces of fabric are retained under the sections (T2) by the last section (6*d*) of the rod (6) that creates some friction against the fabric pieces.

The facing (M) is reversed by the teeth (8*a*) of the comb (8).

The fourth step (IV) (FIG. 11) starts when the third descending step (III) is completed and a shutter (9) is lowered to ensure the reversal of the facing (M).

During the fifth and last step (V) at the reverse station (SR) a bracket (10) with claws (11) (see FIG. 12) is lowered to block the fabric (T) and transfer it to the ironing station (SS), while the shutter (9) and the leg-holder frame (3) are raised.

Before the transfer to the ironing station (SS) starts, a tubular blade (12) extends and moves astride the pocket cut, where it remains until the fabric (T) is brought from the overturning station (SR) to the ironing station (SS) in order to maintain the folding obtained in the reversal station (SR).

Finally, it must be noted that both the bracket (10) and the tubular blade (12) are guided and supported by a track (B2) during their alternate travels.

The transfer to the ironing station (SS) is carried out by translating the fabric (T) along the axis (X—X) of the pocket cut (TT).

Being now reversed under the worktop (P), the edges (F), the reinforcement (R) and the facing (M) slide inside the slot (2) that extends from the reversal station (SR) to the ironing station (SS).

The slot (2) ends in a rectangular window (13) at the ironing station (SS) (see FIGS. 7 and 12), which receives the fabric (T) to allow the ironing means (14, 14*a*) located under and over the worktop (P) in the window (13) to perform their function correctly.

As shown in FIG. 12, two pairs of threads (15, 15*a*) run on the worktop (P); the threads of the first pair (15) run inside the slot (2) and the window (13) in parallel close position with respect to the border of the slot (2), while the threads of the second pair (15*a*) are located in the window (13).

More precisely, the two threads of the second pair (15*a*) are fixed to the connection vertexes (13*a*) between the slot (2) and the window (13), respectively, and move with diverging direction through the window (13), as shown in FIG. 12.

After reversal, the first pair of threads (15) is engaged under the fabric (T) (see FIG. 6) so that during the translation from the reversal station (SR) and the ironing station (SS) the reversed position of the edges (F), of the reinforcements (R) and of the facing (M) is perfectly maintained.

Likewise, the second pair of threads (15*a*), that is to say the threads located in the window (13), ensures the correct position during ironing, since the threads (15*a*) cooperate to support the fabric and extend the edges (F), the reinforcements (R) and the facing (M), thus avoiding the creation of folds that may impair ironing.

The ironing means (14, 14*a*) comprise a first fixed buffer (14) located immediately under the worktop (P) in the window (13) and a second buffer (14*a*) located over the first buffer (14) and provided with vertical alternate motion in order to adhere to the first fixed buffer (14).

Being known conventional devices, the description of constructive and functional details of the ironing buffers (14, 14*a*) is not necessary, with the only technical innovation being the presence of the two pair of threads (15, 15*a*).

It is understood that the sequence of operational steps is controlled and managed by an electronic control unit that operates the actuators in the correct sequence to operate the mobile elements of the manipulator of the invention, which includes sensors or proximity switches, whose signals are received and processed by the control unit in order to start and stop the aforementioned actuators.

The invention claimed is:

1. Manipulator used to reverse the edges of slash pockets, designed to operate with a semi-finished product (SE) made of a piece of fabric (T) laid on a worktop (P) with seams (C1 and C2) to fix the edge (F), the reinforcement (R) and the facing (M), all of them being previously folded with reversed-T shape, and with the pocket cut (TT) in parallel central position with respect to the seams (C1 and C2), characterized by the fact that it comprises:

a reversal station (SR) with a through slot (2) on the worktop (P);

pick-up means (1, 1*a*, B1) used to pick up the semi-finished product (SE) from a pick-up station (SP) located on the worktop (P) and transfer it to the reversal station (SR);

fastening means (4, 4*a*) used to fasten the semi-finished product (SE) at the reversal station (SR);

reversal means (MR) actuated at the reversal station (SR) to reverse the edges (F), the reinforcements (R) and the facing (M) under the worktop (P);

an opposite pair of movable jaws (5) supported by a frame (3) that actuate over the worktop in the slot (2), designed to cooperate with the reversal means (MR) to favor the contact reversal of the edges (F), the reinforcements (R) and the facing (M) under the worktop (P);

a shutter (9) actuated in the slot (2) designed to favor the correct reversal of the edges (F), the reinforcements (R) and the facing (M) under the worktop (P);

actuators used to operate the pick-up means (1, 1*a*, B1), the fastening means (4, 4*a*), the reversal means (MR), the opposite pair of jaws (5) and the shutter (9);

an electronic control unit used to start and stop the aforementioned actuators based on the signals received by suitable sensors or proximity switches associated with the mobile elements of the manipulator.

2. Manipulator according in claim 1, characterized in that the pick-up means (1, 1*a*, B1) consist in a track (B1) with a sliding extendable blade (1) and a fork (1*a*) that can be independently lowered to press the fabric (T).

3. Manipulator used to reverse the edges of slash pockets, designed to operate with a semi-finished product (SE) made of a piece of fabric (T) laid on a worktop (P) with seams (C1 and C2) to fix the edge (F), the reinforcement (R) and the facing (M), all of them being previously folded with reversed-T shape, and with the pocket cut (TT) in parallel central position with respect to the seams (C1 and C2), characterized by the fact that it comprises:

a reversal station (SR) with a through slot (2) on the worktop (P);

pick-up means (1, 1*a*, B1) used to pick up the semi-finished product (SE) from a pick-up station (SP) located on the worktop (P) and transfer it to the reversal station (SR);

fastening means (4, 4*a*) used to fasten the semi-finished product (SE) at the reversal station (SR);

reversal means (MR) actuated at the reversal station (SR) to reverse the edges (F), the reinforcements (R) and the facing (M) under the worktop (P);

an opposite pair of jaws (5) that actuate over the worktop in the slot (2), designed to cooperate with the reversal means (MR) to favor the contact reversal of the edges (F), the reinforcements (R) and the facing (M) under the worktop (P);

a shutter (9) actuated in the slot (2) designed to favor the correct reversal of the edges (F), the reinforcements (R) and the facing (M) under the worktop (P);

actuators used to operate the pick-up means (1, 1*a*, B1), the fastening means (4, 4*a*), the reversal means (MR), the opposite pair of jaws (5) and the shutter (9);

an electronic control unit used to start and stop the aforementioned actuators based on the signals received by suitable sensors or proximity switches associated with the mobile elements of the manipulator, wherein the fastening means (4, 4*a*) comprise feet (4*a*) at the base of respective legs (4) supported by a bearing frame (3), with the possibility of making alternate vertical travels, which also supports the jaws (5) matched to the frame (3) in such a way that they can make simultaneous opposite alternate horizontal travels.

4. Manipulator used to reverse the edges of slash pockets, designed to operate with a semi-finished product (SE) made of a piece of fabric (T) laid on a worktop (P) with seams (C1 and C2) to fix the edge (F), the reinforcement (R) and the facing (M), all of them being previously folded with reversed-T shape, and with the pocket cut (TT) in parallel central position with respect to the seams (C1 and C2), characterized by the fact that it comprises:

a reversal station (SR) with a through slot (2) on the worktop (P);

pick-up means (1, 1*a*, B1) used to pick up the semi-finished product (SE) from a pick-up station (SP) located on the worktop (P) and transfer it to the reversal station (SR);

fastening means (4, 4*a*) used to fasten the semi-finished product (SE) at the reversal station (SR);

reversal means (MR) actuated at the reversal station (SR) to reverse the edges (F), the reinforcements (R) and the facing (M) under the worktop (P);

an opposite pair of jaws (5) that actuate over the worktop in the slot (2), designed to cooperate with the reversal means (MR) to favor the contact reversal of the edges (F), the reinforcements (R) and the facing (M) under the worktop (P);

a shutter (9) actuated in the slot (2) designed to favor the correct reversal of the edges (F), the reinforcements (R) and the facing (M) under the worktop (P);

actuators used to operate the pick-up means (1, 1*a*, B1), the fastening means (4, 4*a*), the reversal means (MR), the opposite pair of jaws (5) and the shutter (9);

an electronic control unit used to start and stop the aforementioned actuators based on the signals received by suitable sensors or proximity switches associated with the mobile elements of the manipulator, wherein the reversal means (MR) comprise:

a pair of bearing rods (6), with a distance lower than a distance between the jaws (5), which rest in an idle position under the worktop (P) on the slot (2), it being provided that each bearing rod (6) has a square truncated base (6*a*) with sides larger than a distance between the two seams (C1 and C2) and the truncated base (6*a*) is joined with the rod (6) by means of a step (6*b*), a metal rod (7) being wound up helicoidally, with a first turn (7*a*) raised with respect to the connection step (6*b*) so that a short section (6*c*) of the rod between the step (6*b*) and the first turn (7*a*) and a top section (6*d*) of the rod (6) over a last turn (7*b*) of the metal rod (7) remain uncovered;

a vertical pin (8) located inside each rod (6) with horizontal teeth (8*a*) laying on a vertical plane passing through the longitudinal symmetrical axis of the slot (2).

5. Manipulator used to reverse the edges of slash pockets, designed to operate with a semi-finished product (SE) made of a piece of fabric (T) laid on a worktop (P) with seams (C1 and C2) to fix the edge (F), the reinforcement (R) and the facing (M), all of them being previously folded with reversed-T shape, and with the pocket cut (TT) in parallel central position with respect to the seams (C1 and C2), characterized by the fact that it comprises:

a reversal station (SR) with a through slot (2) on the center of the worktop (P);

pick-up means (1, 1*a*, B1) used to pick up the semi-finished product (SE) from a pick-up station (SP) located on the worktop (P) and transfer it to the reversal station (SR);

fastening means (4, 4*a*) used to fasten the semi-finished product (SE) at the reversal station (SR);

reversal means (MR) actuated at the reversal station (SR) to reverse the edges (F), the reinforcements (R) and the facing (M) under the worktop (P);

an opposite pair of movable jaws (5) supported by a frame (3) that actuate over the worktop in the slot (2), designed to cooperate with the reversal means (MR) to favor the contact reversal of the edges (F), the reinforcements (R) and the facing (M) under the worktop (P);

a shutter (9) actuated in the slot (2) designed to favor the correct reversal of the edges (F), the reinforcements (R) and the facing (M) under the worktop (P);

actuators used to operate the pick-up means (1, 1*a*, B1), the fastening means (4, 4*aq*), the reversal means (MR), the opposite pair of jaws (5) and the shutter (9);

an electronic control unit used to start and stop the aforementioned actuators based on the signals received by suitable sensors or proximity switches associated with the mobile elements of the manipulator.

the pick-up means (1, 1*a*, B1) consist in a track (B1) with a sliding extendable blade (1) and a fork (1*a*) that can be independently lowered to press the fabric (T), the fastening means (4, 4*a*) comprise feet (4*a*) at the base of respective legs (4) supported by a bearing frame (3), with the possibility of making alternate vertical travels, which also support the jaws (5) matched to the frame (3) in such a way that they can make simultaneous opposite alternate horizontal travels.

the reversal means (MR) having a pair of bearing rods (6), with a distance lower than a distance between the jaws (5), which rest in an idle position under the worktop (P) on the slot (2), it being provided that each bearing rod (6) has a square truncated base (6*a*) with sides larger than a distance between the two seams (C1 and C2) and the truncated base (6*a*) is joined with the rod (6) by means of a step (6*b*), a metal rod (7) being wound up helicoidally, with a first turn (7*a*) raised with respect the connection step (6*b*) so that a short section (6*c*) of the rod between the step (6*b*) and the first turn (7*a*) and a top section (6*d*) of the rod (6) over a last turn (7*b*) of the metal rod (7) remain uncovered; and further characterized in that the electronic control unit enables the following operations in the given order to carry out a working cycle;

lowering of the fork (1*a*) at the pick-up station (SP) to fasten the fabric in two points near the pocket cut (TT);

lowering of the blade (1) that extends and holds the fabric (T) in position;

sliding of the fork (1*a*) and the blade (1) along the track (B1) in order to position the semi-finished product (SE) in the center of the reversal station (SR) over the slot (2);

lowering of the frame (3) with consequent fastening of the fabric by the feet (4*a*) of the legs (4);

raising of the blade (1);

raising of the reversal means (MR) from underneath the worktop (P) by passing through the slot (2) and the pocket cut (TT);

advancing of the jaws (5) and diverging of the rods (6) until the truncated bases (6*a*) engage against the jaws;

lowering of the reversal means (MR), interrupting the diverging action on the rods (6) when the truncated base (6*a*) is brought under the slot (2) and interrupting the advancing action on the jaws (5) when the first turn (7*a*) is brought under the slot (2);

diverging of the rods (6) when the reversal means (MR) have completed their descending travel;

lowering of the shutter (9) when the reversal means (MR) have completed their descending travel;

raising of the shutter (9);

diverging of the jaws (6);

raising of the frame (3);

lowering of a bracket (10) with claws (11) located at the reversal station (SR) and designed to collect the semi-finished product (SE) with reversed edges;

sliding of the fork (1*a*) and the blade (1) along the track (B1) in order to return to the pick-up station (SP).

6. Manipulator used to reverse the edges of slash pockets, designed to operate with a semi-finished product (SE) made of a piece of fabric (T) laid on a worktop (P) with seams (C1 and C2) to fix the edge (F), the reinforcement (R) and the facing (M), all of them being previously folded with reversed-T shape, and with the pocket cut (TT) in parallel central position with respect to the seams (C1 and C2), characterized by the fact that it comprises:

a reversal station (SR) with a through slot (2) on the worktop (P):

pick-up means (1, 1*a*, B1) used to pick up the semi-finished product (SE) from a pick-up station (SP) located on the worktop (P) and transfer it to the reversal station (SR): fastening means (4, 4*a*) used to fasten the semi-finished product (SE) at the reversal station (SR);

reversal means (MR) actuated at the reversal station (SR) to reverse the edges (F), the reinforcements (R) and the facing (M) under the worktop (P);

an opposite pair of jaws (5) that actuate over the worktop in the slot (2), designed to cooperate with the reversal means (MR) to favor the contact reversal of the edges (F), the reinforcements (R) and the facing (M) under the worktop (P);

a shutter (9) actuated in the slot (2) designed to favor the correct reversal of the edges (F), the reinforcements (R) and the facing (M) under the worktop (P);

actuators used to operate the pick-up means (1, 1*a*, B1), the fastening means (4, 4*a*), the reversal means (MR), the opposite pair of jaws (5) and the shutter (9);

an electronic control unit used to start and stop the aforementioned actuators based on the signals received by suitable sensors or proximity switches associated with the mobile elements of the manipulator, wherein the manipulator comprises two bridges (H) located under the worktop (P) that, immediately before the frame (3) is lowered, cover the slot (2) in two areas that correspond with the contact points of the feet (4*a*) on the worktop (P) and then are brought back in an idle position when the frame (3) is raised.

7. Manipulator according to claim 5, characterized in that it comprises a track (B2) that supports and guides the sliding bracket (10) and a second tubular blade (12) designed to transfer and bring the semi-finished product (SE) from the reversal station (SR) to the ironing station (SS) located downstream of the reversal station (SR) and comprising a large window (13) on the worktop (P), with two ironing buffers (14, 14*a*) located over and under the window (13); it being provided that the track (B2) is parallel to the longitudinal symmetrical axis (X—X) of the slot (2) that extends and ends in the window (13).

8. Manipulator according to claim 7, characterized in that it comprises two pairs of threads (15, 15*a*) extended on the worktop (P), of which the first pair (15) runs inside the slot (2) and the window (13) in parallel position close to the borders of the slot (2) and the threads of the second pair (15*a*) go through the window (13) with diverging direction starting from the connection vertex (13*a*) between the slot (2) and the window (13).

* * * * *